US006474889B2

(12) United States Patent
Kato

(10) Patent No.: US 6,474,889 B2
(45) Date of Patent: Nov. 5, 2002

(54) TELESCOPIC BALL-POINT PEN

(75) Inventor: Hiroyasu Kato, Tomioka (JP)

(73) Assignee: Katoh Kinzoku Kogyo Kabushiki Kaisha, Gunma-ken (JP)

( * ) Notice: Subject to any disclaimer, the term of this patent is extended or adjusted under 35 U.S.C. 154(b) by 0 days.

(21) Appl. No.: 10/067,900

(22) Filed: Feb. 8, 2002

(65) Prior Publication Data

US 2002/0110402 A1 Aug. 15, 2002

(30) Foreign Application Priority Data

Feb. 9, 2001 (JP) ..... 2001-034142

(51) Int. Cl.[7] ..... B43K 7/12
(52) U.S. Cl. ..... 401/117; 401/107; 401/109
(58) Field of Search ..... 401/117, 99, 103, 401/107, 108, 109, 112

(56) References Cited

U.S. PATENT DOCUMENTS 4,601,599 A * 7/1986 Katoh ..... 401/117
5,967,684 A * 10/1999 Huang et al. ..... 401/117
6,273,627 B1 * 8/2001 Mittersinker et al. ..... 401/117

* cited by examiner

*Primary Examiner*—David J. Walczak
(74) *Attorney, Agent, or Firm*—Bacon & Thomas, PLLC

(57) ABSTRACT

A telescopic ball-point pen comprising a front case and a rear case capable of slidably engaged in the front case and the rear case can be adjusted to make a telescopic motion to reach respective steps, wherein the front case comprises a mouth ring, a front case body, a cylindrical member, a telescopic ball-point pen refill, a coil spring, a slidable tip fitting, a short rod-like member, an engaging concave, of which the front case body, the cylindrical member, a sliding portion of the slidable tip fitting, and the engaging concave are respectively made of synthetic resin, and wherein the rear case comprises a rear case body, a short rod-like member and an engaging convex of which the rear case body and the engaging convex are respectively made of synthetic resin, and wherein the rear case can press the short rod-like member and slidable tip fitting when the rear case body is pushed into the front case body, while the engaging convex of the rear case head cap can be engaged in or disengaged from the engaging concave of the front case body at the position where the rear case body is pushed into the front case body.

1 Claim, 2 Drawing Sheets

TELESCOPIC BALL-POINT PEN

BACKGROUND OF THE INVENTION

1. Field of the Invention

The invention relates to an improvement of a telescopic ball-point pen, and particularly to a telescopic ball-point pen having a body made of synthetic resin.

2. Description of the Related Art

A conventional telescopic ball-point pen is formed of components which are almost made of metal, as disclosed in Japanese Patent Laid-Open Publication No. 2-57040, and hence it has such shortcoming that it comprises many components, and it requires machining accuracy, and its yield are low, resulting in an expensive product. The conventional telescopic ball-point pen has other shortcoming that its durability and corrosion resistance are low because there are many sliding portions between metallic components and its feeling is not good because it makes a noise when it makes telescopic motion.

SUMMARY OF THE INVENTION

The invention intended to solve the drawbacks of the conventional telescopic ball-point pen and to provide a telescopic ball-point pen having components most of which are formed of synthetic resin, designed in the reduction of the number thereof, simplified in assembly thereof, so that it can be provided at a low cost while it becomes excellent in durability and corrosion resistance, and further it has a good feeling when making a telescopic motion.

DESCRIPTION OF THE PREFERRED EMBODIMENTS

Figure 1:
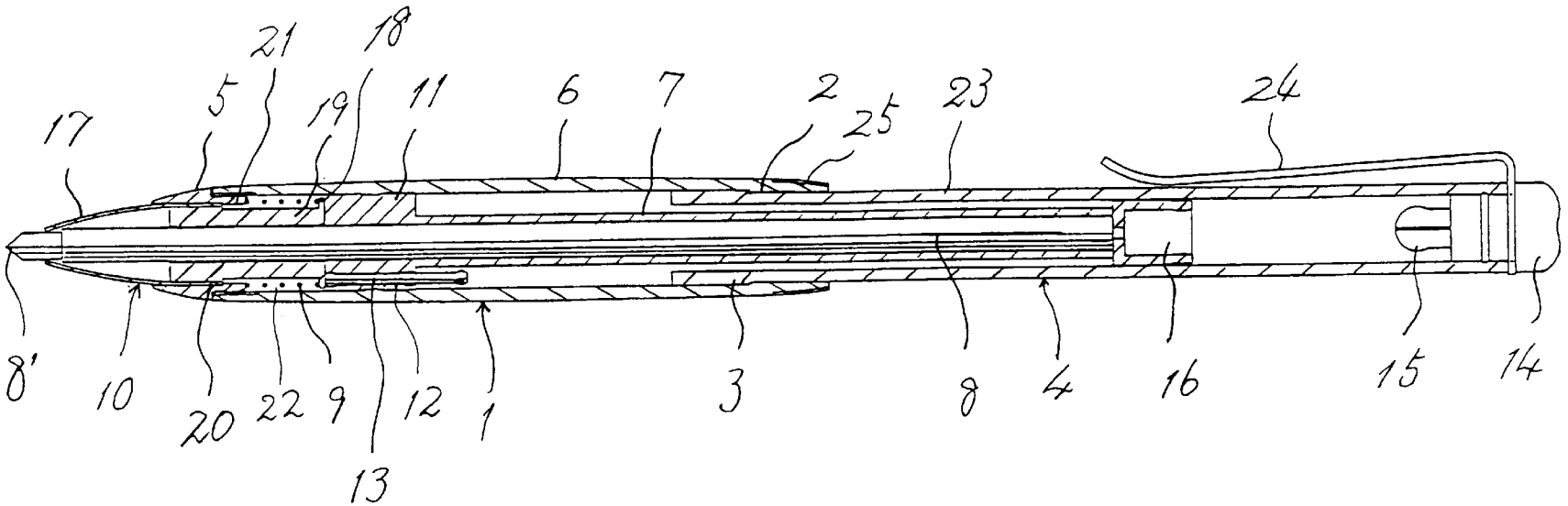
FIG. 1 is a sectional view of a telescopic ball-point pen when it makes an expansion motion of a telescopic motion.

A telescopic ball-point pen according to a preferred embodiment of the invention is now described with reference to the attached drawings. The telescopic ball-point pen comprises a front case 1 and a rear case 4 capable of sliding into the front case 1 and the rear case 4 can be adjusted to make a telescopic motion to reach respective steps 2 and 3. The front case 1 comprises a front case body 6 made of synthetic resin, a mouth ring 5 which is screwed onto the front case body 6, a cylindrical member 7 provided inside the front case body 6 and made of synthetic resin and extended inside a rear case body 23, described later, a telescopic ball-point pen refill 8 capable of detachably inserting into the cylindrical member 7 and protruding a tip 8' of the telescopic ball-point pen refill 8 from the mouth ring 5, a slidable tip fitting 10 capable of protruding to a position where the tip 8' of the telescopic ball-point pen refill 8 can be concealed via a coil spring 9 provided between the telescopic ball-point pen refill 8 and the mouth ring 5, a short rod-like member 13 which contacts the slidable tip fitting 10 at its tip which is freely movable inside a through hole 12 of a fixed pedestal 11 of the cylindrical member 7 so as to press the slidable tip fitting 10 against the spring force of the coil spring 9, and an engaging concave 16 made of synthetic resin and fixed to a base end of the cylindrical member 7 and and engaging with an engaging convex 15 of a rear case head cap 14, described later. The engaging concave 16 slidably contacts the inner side of the rear case body 23 while the step 2 of the front case body 6 of the front case 1 slidably contacts the outer periphery of the rear case body 23 and the step 3 of the rear case body 23 of the rear case 4 slidably contact the inner periphery of the front case body 6.

The slidable tip fitting 10 is divided into a concealing portion 17 made of metal and a sliding portion 19 having a collar 18 which diameter is larger than an inner diameter of the mouth ring 5, wherein a step 20 formed at the joint between the concealing portion 17 and the sliding portion 19 can engage with an inner step 21 of the mouth ring 5, and the coil spring 9 is charged in a space 22 formed by the end of the mouth ring 5 and the collar 18.

The rear case 4 comprises the rear case body 23 made of synthetic resin which is pushed into the front case body 6 to press the short rod-like member 13 and the rear case head cap 14 having the engaging convex 15 made of synthetic resin which can be engaged in or disengaged from the engaging concave 16, wherein the rear case 4 can press the short rod-like member 13 and slidable tip fitting 10 when the rear case body 23 is pushed into the front case body 6, while the engaging convex 15 of the rear case head cap 14 can be engaged in or disengaged from the engaging concave 16 of the front case body 6 at the position where the rear case body 23 is pushed into the front case body 6.

Figure 2:
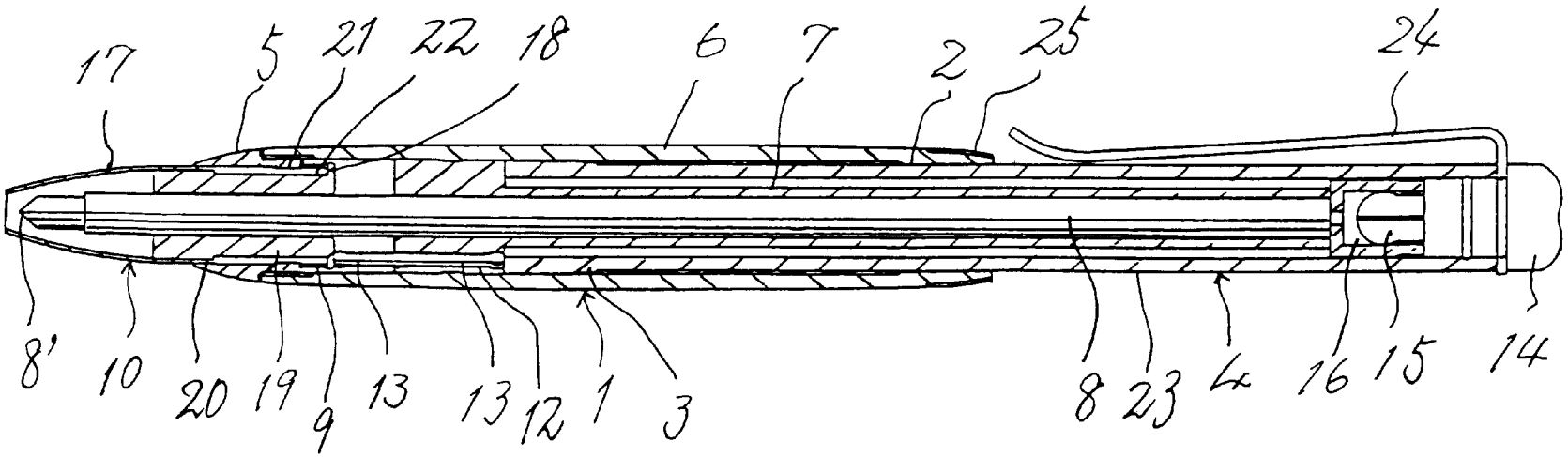
FIG. 2 a sectional view of a telescopic ball-point pen when it makes an contraction motion of the telescopic motion.

In FIGS. 1 and 2, depicted by 24 is a clip and 25 is a reinforcing ring.

Intervals between the mouth ring 5, concealing portion 17, and collar 18 of the slidable tip fitting 10, and lengths of the coil spring 9, short rod-like member 13, engaging concave 16, engaging convex 15 cylindrical member 7, and telescopic ball-point pen refill 8 are determined by their functional or positional relation.

With the construction of the telescopic ball-point pen of the invention, when the telescopic ball-point pen is telescopically moved from the state in the contracted state in FIG. 2 to an expanded state in FIG. 1, the rear case body 23 is retracted or pulled rearward to forcibly release the engagement between the engaging concave 16 and the engaging convex 15, whereby the compression between the short rod-like member 13 and the rear case body 23 is released so that the slidable tip fitting 10 is pressed inward, namely, rightward in FIG. 1, by the coil spring 9 when the rear case body 23 is pulled rearward, and the tip 8' of the telescopic ball-point pen refill 8 is exposed outside the slidable tip fitting 10 at the same time, rendering the telescopic ball-point pen in a writing condition.

When the rear case body 23 is pulled or stretched rearward at a limit (engaging position of the steps 2 and 3), the entire length of the telescopic ball-point pen becomes the longest (FIG. 1).

On the contrary, when the telescopic ball-point pen is telescopically moved from the expanded state in FIG. 1 to the contracted state in FIG. 2, the operation reverse to the foregoing expansion operation is effected, namely, when the rear case body 23 is pushed forward so that the front end of the rear case body 23 presses the short rod-like member 13 to push the collar 18 of the slidable tip fitting 10, and the concealing portion 17 of the slidable mouth ring 5 is pushed forward against the spring force of the coil spring 9 to conceal the tip 8' of the telescopic ball-point pen refill 8 while the engaging convex 15 is engaged in the engaging concave 16, whereby the telescopic ball-point pen becomes in the contracted state shown in FIG. 2.

As mentioned in detail above, the telescopic ball-point pen comprises the front case and the rear case capable of slidably engaged in the front case and the rear case can be adjusted to make a telescopic motion to reach respective steps, wherein the front case comprises the front case body made of synthetic resin, the mouth ring which is screwed onto the front case body, the cylindrical member provided inside the front case body and made of synthetic resin, and extended inside the rear case body, the telescopic ball-point pen refill capable of detachably inserting into the cylindrical member and protruding the tip of the telescopic ball-point pen refill from the mouth ring, and the slidable tip fitting slidable tip fitting capable of protruding to the position where the tip of the telescopic ball-point pen refill can be concealed via the coil spring provided between the telescopic ball-point pen refill and the mouth ring, the short rod-like member which contacts the slidable tip fitting at its tip which is freely movable inside the through hole of the fixed pedestal of the cylindrical member so as to press the slidable tip fitting against the spring force of the coil spring, and the engaging concave made of synthetic resin and fixed to the base end of the cylindrical member and engaging with the engaging convex of the rear case head cap, wherein the slidable tip fitting is divided into the concealing portion and the sliding portion having the collar which diameter is larger than the inner diameter of the mouth ring, and wherein the step formed at the joint between the concealing portion and the sliding portion can engage with the inner step of the mouth ring, and the coil spring is charged in the space formed by the end of the mouth ring and the collar, and wherein the rear case comprises the rear case body made of synthetic resin which is pushed into the front case body to press the short rod-like member and the rear case head cap having the engaging convex made of synthetic resin which can be engaged in or disengaged from the engaging concave, wherein the rear case can press the short rod-like member and slidable tip fitting when the rear case body is pushed into the front case body, while the engaging convex of the rear case head cap can be engaged in or disengaged from the engaging concave of the front case body at the position where the rear case body is pushed into the front case body. Accordingly, since the most of the components are made of synthetic resin, and they can be manufactured by an integral molding, abbreviated in the number of machining steps to a large extent compared with those of a metallic telescopic ball-point pen, simplified in assembly thereof, and the number of the components can be reduced to a large extent, so that the telescopic ball-point pen can be provided at a low cost.

What is claimed is:

1. A telescopic ball-point pen comprising a front case and a rear case capable of being slidably engaged in the front case and the rear case can be adjusted to make a telescopic motion to reach respective steps;

wherein the front case comprises a front case body made of synthetic resin, a mouth ring which is screwed onto the front case body, a cylindrical member provided inside the front case body and made of synthetic resin, and extended inside a rear case body, a telescopic ball-point pen refill capable of detachably inserting into the cylindrical member and protruding a tip of the telescopic ball-point pen refill from the mouth ring, a slidable tip fitting capable of protruding to a position where the tip of the telescopic ball-point pen refill can be concealed against a coil spring provided between the telescopic ball-point pen refill and the mouth ring a short rod-like member which contacts the slidable tip fitting at its tip which is freely movable inside a through hole of a fixed pedestal of the cylindrical member so as to press the slidable tip fitting against a spring force of the coil spring, and an engaging concave and made of synthetic resin and fixed to a base end of the cylindrical member and engaging with an engaging convex of a rear case head cap;

wherein the slidable tip fitting is divided into a concealing portion and a sliding portion having a collar which diameter is larger than an inner diameter of the mouth ring, and wherein a step formed at a joint between the concealing portion and the sliding portion can engage with an inner step of the mouth ring, and the coil spring is charged in a space formed by the end of the mouth ring and the collar; and wherein the rear case comprises the rear case body made of synthetic resin which is pushed into the front case body to press the short rod-like member and the rear case head cap having the engaging convex made of synthetic resin which can be engaged in or disengaged from the engaging concave, wherein the rear case can press the short rod-like member and slidable tip fitting when the rear case body is pushed into the front case body, while the engaging convex of the rear case head cap can be engaged in the engaging concave of the front case body at the position where the rear case body is pushed into the front case body.

* * * * *